US005490361A

United States Patent [19]

Gingras

[11] Patent Number: 5,490,361

[45] Date of Patent: Feb. 13, 1996

[54] MODULAR PANEL FOR RIGHT ANGLE INTERCONNECTION

[76] Inventor: Jean-Pierre Gingras, 1693 Marie-Dubois, Carignan, Quebec, Canada, J3L 3P9

[21] Appl. No.: 172,949

[22] Filed: Dec. 27, 1993

[51] Int. Cl.[6] ..... E04C 3/00

[52] U.S. Cl. ..... 52/578; 52/582.1; 52/270; 52/284; 52/784.13

[58] Field of Search ..... 52/578, 579, 582.1, 52/582.2, 591.1, 591.5, 802, 803, 262, 269, 270, 272, 275, 284, 285.1, 127.9, 264

[56] References Cited

U.S. PATENT DOCUMENTS

| | | | |
|---|---|---|---|
| 935,402 | 9/1909 | Piver | 52/578 |
| 1,842,828 | 1/1932 | Giuliani | 52/284 X |
| 2,394,147 | 2/1946 | Bruton et al. | 52/578 |
| 2,647,287 | 8/1953 | Jones et al. . | |
| 2,756,464 | 7/1956 | Clements | 52/578 |
| 3,061,894 | 11/1962 | Kamisato | 52/284 |
| 3,496,692 | 2/1970 | Melcher . | |
| 4,574,537 | 3/1986 | Krieger | 52/285.1 X |
| 5,212,924 | 5/1993 | Finkelstein . | |

FOREIGN PATENT DOCUMENTS

| | | | |
|---|---|---|---|
| 2446508 | 4/1976 | Germany | 52/264 |

*Primary Examiner*—Carl D. Friedman
*Assistant Examiner*—Kien T. Nguyen

[57] ABSTRACT

An interconnectable modular panel of rectangular shape having longitudinal right-angle connecting recesses in opposed end walls thereof. An elongated connector member is secured in the connecting recess with a portion of the recess defining an abutment end wall portion which is dimensioned and adapted to receive and rest on an outer surface of another elongated connector member of a connecting element to be secured to the recess. The panel is also provided with other type connector members along the opposed side edges thereof to connect with other panels positioned edge to edge.

7 Claims, 5 Drawing Sheets

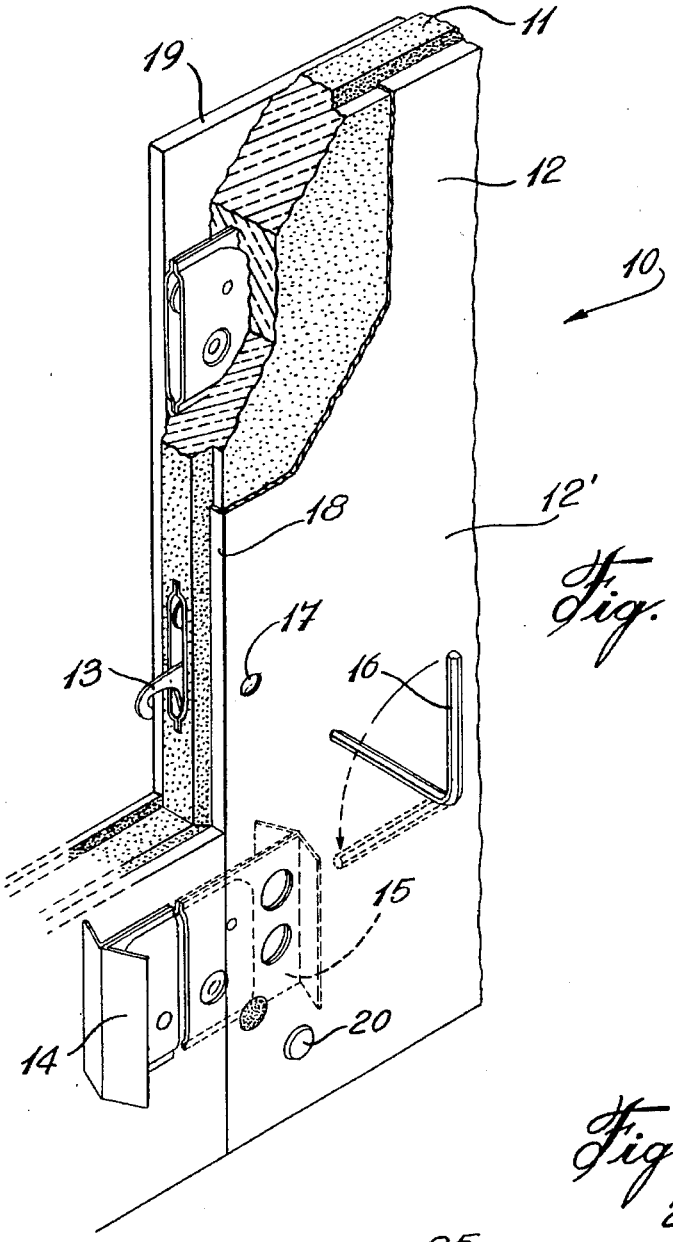
Fig. 1A (PRIOR ART)
Fig. 2
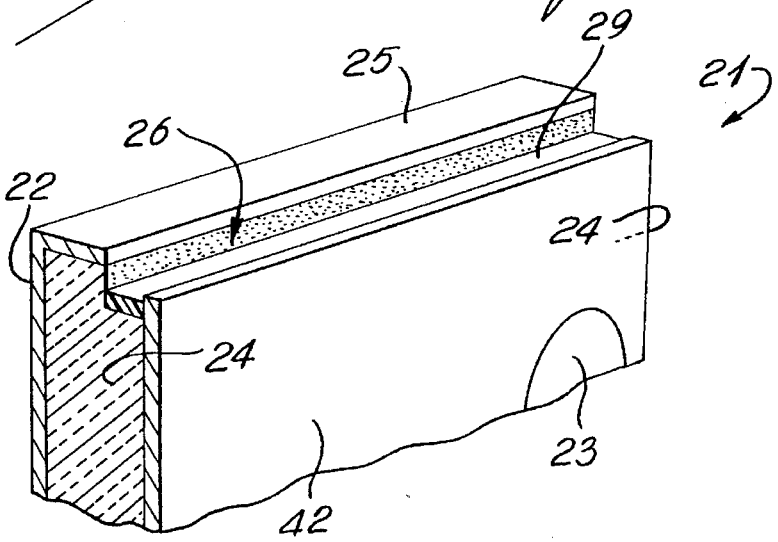

MODULAR PANEL FOR RIGHT ANGLE INTERCONNECTION

TECHNICAL FIELD

The present invention relates to an interconnectable rectangular modular panel for the fabrication of enclosures wherein the opposed end edges of the panels are provided with right-angle connecting recesses capable of receiving screw fasteners in the corners of enclosures fabricated thereby, and particularly for the fabrication of refrigerated enclosures.

BACKGROUND ART

The modular panel of the present invention is of the type as exemplified, for example, by U.S. Pat. Nos. 5,212,924; 3,496,692; and 2,647,287 wherein panels are interconnected together along their top and side edges by latching devices and wherein a male component is installed in one panel and matches with a female component of an adjacent panel. One disadvantage of these panels is that they are costly to fabricate due to the cost and installation of the latches and the panels. Also, because these latch devices have male and female parts, it sometimes complicates the assembly of the panels in that different size panels are required to construct specific enclosures. It is difficult to provide a modular panel with this type of fastener assembly, and with tongue and grooves molded in the side and end edges of the panel and also in the side walls adjacent end or side edges thereof.

SUMMARY OF INVENTION

It is a feature of the present invention to provide an interconnectable rectangular modular panel wherein at least the end edges of the panel are provided with a connecting recess which permits interconnection of panels from inner corners thereof by the use of conventional fasteners.

Another feature of the present invention is to provide an interconnectable rectangular modular panel and system based on a standard module size and which can be enlarged by standard increments.

Another feature of the present invention is to provide an interconnectable rectangular modular panel which is easier to fabricate than prior art panels of this type, and wherein at least the connecting recess in the opposed end edges of the panels are less costly to fabricate.

Another feature of the present invention is to provide an interconnectable rectangular modular panel for the construction of refrigerated enclosures and which permits the enclosure to be erected more quickly than prior art insulated panel assemblies of this type.

According to the above features, from a broad aspect, the present invention provides an interconnectable rectangular modular panel having opposed parallel outer and inner surfaces, side edges, and end edges. The end edges each have a longitudinal right-angle connecting recess therealong and extend from across the side edges and opening in the inner one of the panel surfaces. The longitudinal right-angle connecting recess defines a transverse end wall and a lateral planar flat wall. An elongated connector member is secured along the connecting recess and is disposed in contact with the transverse end wall in a rear portion of the lateral planar flat wall. The lateral planar flat wall defines an abutment end wall portion dimensioned and adapted to receive and rest on an outer surface of another elongated connector member of a connecting element to be secured to the connecting recess. The connector member and the another connector member are constructed from material capable of receiving fasteners therein. The panel connecting recess when mated with the another connecting member has at least portions of the connector members positioned alongside of one another and in contact with one another whereby fasteners may be introduced through the connector member from a side of the inner surface of the panel to secure the connectors together. Further connecting means are also provided along the side edges of the panels.

BRIEF DESCRIPTION OF DRAWINGS

A preferred embodiment of the present invention will now be described with reference to the accompanying drawings, in which:

FIGS. 1A and 1B are perspective and section views respectively illustrating an insulated panel of the prior art provided with latching devices;

FIG. 2 is a fragmented perspective end view showing a right-angle connecting recess provided along the opposed end edges of a modular panel of the present invention;

BRIEF DESCRIPTION OF DRAWINGS

Figure 1B:
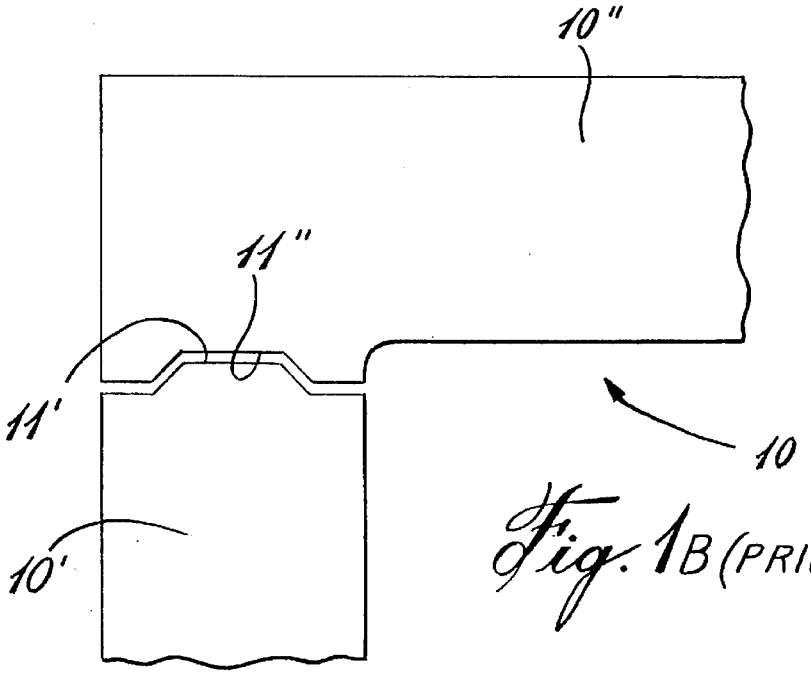
Fig. 1B (PRIOR ART)

Referring to the drawings, and more particularly to FIGS. 1A and 1B, there is shown generally at 10 a rectangular panel constructed in accordance with the prior art. The panel consists of an insulating core 11 having a pre-painted steel outer sheeting 12 secured thereto. Edge latch devices consist of a male latch connector 13 and a female latch connector 14. These connectors are anchored within the insulating core 11 by an anchoring device 15. These connectors are positioned in a mold and the insulating core 11 is molded thereabout. The male latch connector 13 is operated by a key 16 which is insertable from the interior surface 12' of the panel through a hole 17 disposed close to the side edge 18 of the panel. Similar latch connectors are also provided adjacent the top edge 19 of the panel. The holes 17 are concealed by plugs 20. As can be seen, these panels are quite expensive to fabricate and time consuming to install because there is a need to orient the panels properly so that a male latch is disposed adjacent a female latch connector, and this is both for the side edges, top and bottom edges of the panels. The panels are also expensive to fabricate, as previously described.

As can also be seen from FIGS. 1A and 1B, the top and side edges of these panels when used as a side wall 10' have to be molded with a male protrusion 11' in one of its end edge or both, depending on the application, as well as in one of its side edges, and a female cavity, such as 11", in the other of its side edge or end edge, the selection of these protrusions or cavities depending on the application of the panels. For example, as shown in FIG. 1B, when a panel, such as panel 10" is to be used as a ceiling panel or roof panel, it must be formed with a cavity 11" adjacent a side wall end edge portion, as illustrated. Accordingly, these panels are not versatile in that various different types of panels must be molded to suit specific purposes. The end result is that it is necessary to maintain many panels in inventory because of the specific applications. It is also complicated and costly to fabricate due to the various molds or mold inserts that are required.

Figure 3:
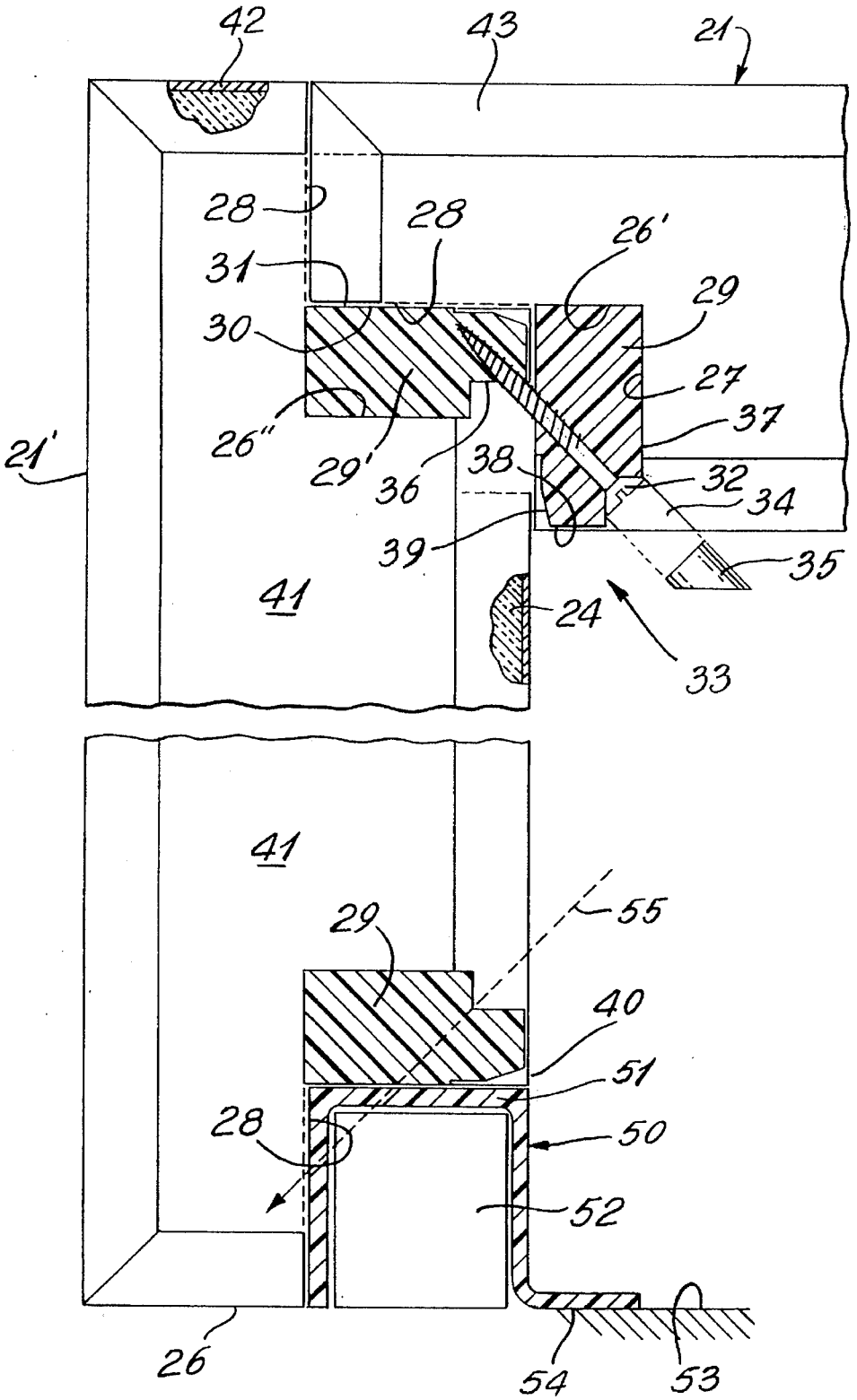
FIG. 3 is an enlarged cross-section view showing the interconnection of a side wall panel to a roof wall panel along the corners thereof using the connecting recess of the present invention as well as the connection of the side wall panel to a floor connector member.

With reference now to FIGS. 2 and 3, there will be described the construction of the interconnectable rectangular modular panel 21 of the present invention. It, like the prior art panels, is made rectangular and defines opposed parallel outer and inner surfaces 22 and 23, respectively, opposed parallel side edges 24, and opposed parallel end edges 25. The end edges 25 are each provided with a longitudinal right-angle connecting recess 26 therealong extending from across the side edges 24, and opening in the inner surface 23 of the panel 21.

As better shown in FIG. 3, the longitudinal right-angle connecting recess 26 defines a transverse end wall 27 and a lateral planar flat wall 28. An elongated connector member 29, herein constructed of PVC, is secured along the connecting recess 26 disposed in contact with the transverse end wall 27 in a rear portion of the lateral planar flat wall 28. The lateral planar flat wall 28 defines an abutment end wall portion 30 which is dimension and adapted to receive and rest on an outer surface 31 of another elongated connector member, such as 29' of a connecting element, herein another connector member 29' of another modular panel 21 serving as a wall panel, whereby two of the panels may be interconnected together along their connecting recesses with the panels extending at right angle to one another, and with the abutment end wall portion of one of the connecting recesses, herein recess 26', abutting the outer surface 31 of the connector member 29' of the other connecting recess 26". Screw fasteners 32 are introduced from an inner corner 33 of the two panels to interconnect them together in a simple fashion. After the fastener is introduced to interconnect the connectors 29 and 29' together the hole 34, where the fastener entered the panel 21, is concealed with a plug 35.

Referring again to FIG. 3, it can be seen that the elongated connector members 29 are provided with a screw receiving inner corner recess 36 extending therealong. This recess is provided adjacent the interior surface 37 of the connector member 29 adjacent the outer end surface 38. This corner recess provides a seat for the head of the screw fasteners 37, as herein illustrated, and provides an alignment means for the screw to be inserted at the proper angle to interconnect both abutting connector members 29 and 29' together. The connectors also have a tapered surface end portion 39 opposite the inner corner recess 36 to facilitate mating of two of the panels together along the respective connecting grooves. This tapered surface will permit the outer sheeting 40 to bend inwardly when the panels are tight-fitted together during installation.

The modular panels of the present invention also have a solid core 41 formed of insulating material, such as rigid polyurethane foam, provided with a cover sheet 42 of suitable material, such as aluminum or galvanized steel sheeting, which is secured over opposed outer and inner surfaces of the panel. These sheets 42 have a contour flange 43 secured to outer edge portions of the side edges extending over the end edges above the connecting recess, as clearly shown in FIG. 2. As shown in FIG. 2, the elongated connector member 29 is concealed by the cover sheet 42 and is not visible from the interior of an enclosure constructed with these panels. Accordingly, there is provided a clean inner surface finish to an enclosure constructed thereby.

Although not shown, the panels of the present invention are also provided with suitable connecting means, such as one or more latch connectors, along their side edges for interconnecting adjacent panels along their abutting side edges. These connector are of the type well known in the art, and are not shown or disclosed herein.

Referring again to FIG. 3, the vertical wall panel 21 is herein shown secured at the base thereof by its right-angle connecting recess 26 which is disposed over a floor connector member 50. The floor connector member is extruded plastic channel defining a U-shape channel 51 which is secured over a securing core strip 52 and the floor connector member 50 is secured in the floor surface 53 by its flange portion 54. A screw fastener is then inserted along the axis 55, as herein shown, and accordingly the side wall panel 21' is secured at its bottom end to a rigid connector 50. A floor slab may then be poured over the floor surface 53, if desired, or the floor surface may be already suitable for the enclosure.

Figure 4:
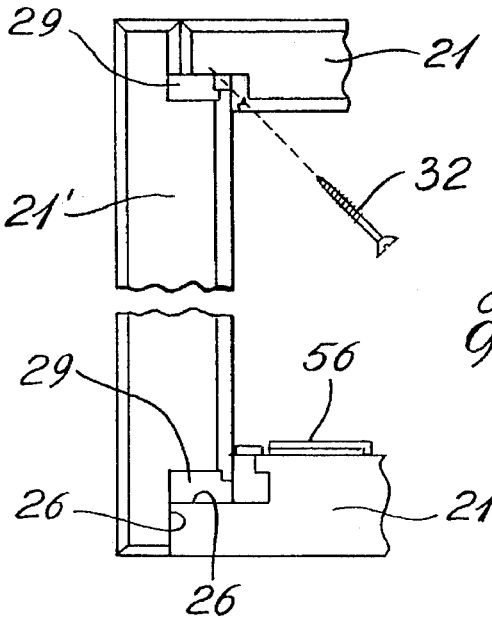
FIG. 4 is a side view illustrating how the modular panels are interconnected together using screw fasteners to form an enclosure and further illustrates the construction of a floor for the enclosure.

As shown in FIG. 4, the panel of the present invention may also be utilized as a floor panel 21" wherein its right-angle connecting recess 26 is mated with the right-angle connecting recess 26 of the vertical wall panel 21'. The inner surface 23 of the floor panel 21" may also be covered by galvanized tiling 56 provided with rigid backing. The tiles 56 may be secured to the same module as those used for the panels. Accordingly, the enclosure fabricated in accordance with FIG. 4A would provide a completely insulated enclosure.

Figure 7:
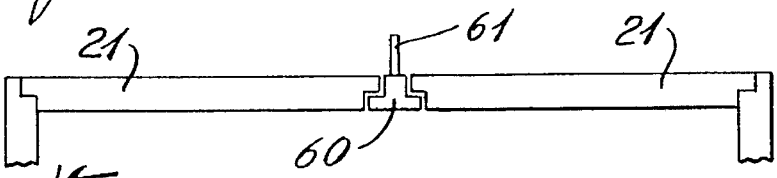
FIG. 7 is a cross-section view showing two modular panels of the present invention interconnected end to end and supported by a joint connector to form a ceiling of longer span.

Referring now to FIG. 7, there is shown another type of elongated connector member, herein a joint connector 60 for interconnecting two of the modular panels 21 in end-to-end planar alignment. The joint connector 60 is provided with a suspension cable, or other type suspension member 61, which would be anchored to a ceiling elevated from the top wall of the enclosure. The joint connector is also provided with elongated connector members 29 in the right-angle recess provided on opposed sides thereof, or the entire joint connector may be constructed of a single piece of wood.

Figure 5:
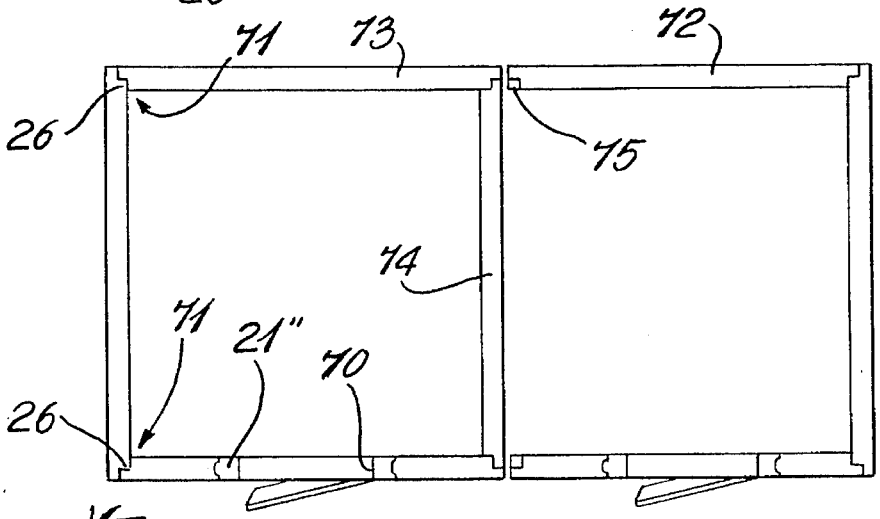
FIG. 5 is a plan view show how two refrigerated chambers can be constructed side by side using the modular panel of the present invention.
Figure 6:
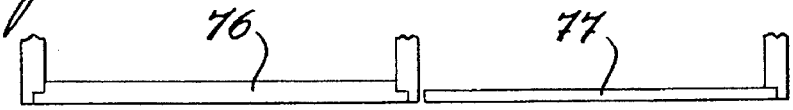
FIG. 6 is a fragmented cross-section view showing two different floor constructions for the refrigerated chambers of FIG. 5.

Referring now to FIGS. 5 and 6, there is shown a simplified version of refrigerated chambers or enclosures constructed with the panels of the present invention. The module width of the modular system of the present invention is 11¾ inch. It is therefore possible to fabricate enclosures having dimensions starting at 5 feet 10½ inch by 6 feet 1½ inch up to infinite dimensions. The dimensions increase by 11¾ inch for each additional required foot. The height varies from 5 feet 7½ inch to 11 feet 6 inches by increments of 11¾ inch. Because of the modular aspect of these panels, it is possible to stock pile an inventory of panels thereby having these readily available for shipping to customers so that these enclosures can be erected quickly. The panels are also interchangeable and can be used for the construction of walls, ceilings or floors.

With reference to FIG. 5, there is shown two refrigerated housings secured side by side wherein the panels 21" are provided with door openings 70 therein which are wider. An advantage of the modular system is that the door openings can be made at the factory and need not be provided along an edge of a panel or between two panels, but formed within a single panel. This saves considerable assembly time. Furthermore, as herein illustrated, some of the panels may be provided with right-angle connecting recesses 26 along one of their side edges to form the corners 71 of the enclosure. These corners can also be secured with screw fasteners. Where an enclosure, such as enclosure 72, is secured to an existing enclosure, such as enclosure 73, then in order to connect the second enclosure 72 thereto and to utilize the existing insulating wall 74, it is simply necessary to install a connector member 75, similar to the connector member 50 which is used as a floor connector, along the vertical side edge of the side wall 74, but spaced inwardly to be received on the flat wall surface 28 of the connecting recess.

FIG. 6 illustrates again the construction of different floors wherein the floor 76 is constructed of panels of the present invention, and floor 77 constructed of a concrete slab or other flooring material.

Figure 8:
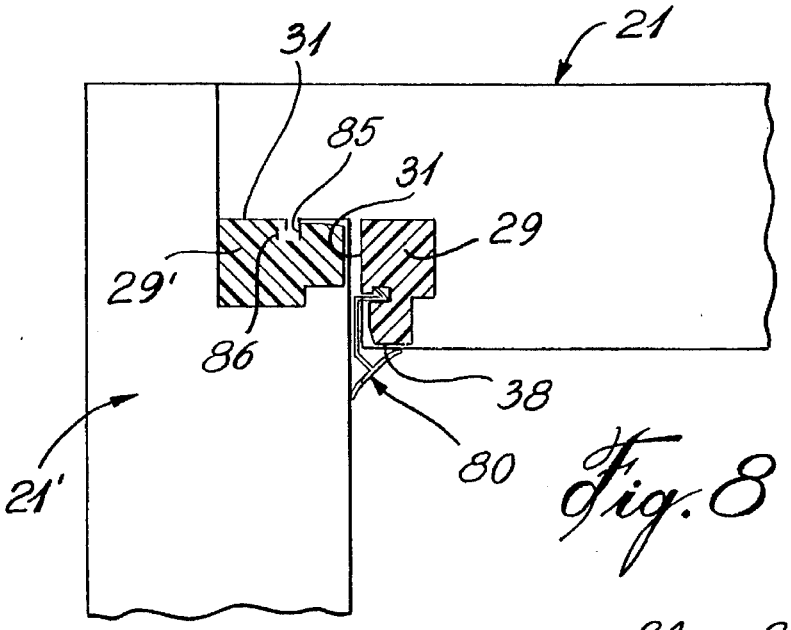
FIG. 8 is a cross-section view illustrating a modification wherein a flexible corner molding is connected to the connector.
Figure 9:
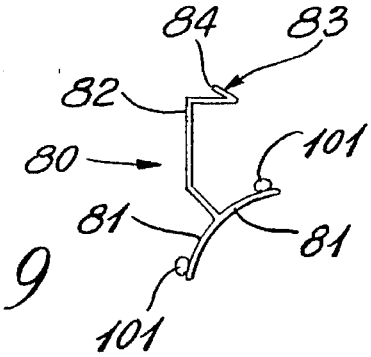
FIG. 9 is a cross-section view of the corner molding.

Referring now to FIGS. 8 and 9, there is illustrated a flexible molding 80 which is connected to one of the connector members 29 which has its outer end surface 38 closest to the inner corner 33, as shown in FIG. 3. The flexible molding 80 is formed of a plastic extrusion and has an elongated flat right-angle portion 81 of substantially concave cross-section, and a rearwardly extending clip portion 82 provided with an attaching free end 83. The attaching free end has a flexible retention flange 84 for frictional removable retention along a clip receiving channel 85 formed along the abutting outer surface 31 of the connector member 29. The clip receiving channel 85 is spaced from the outer end surface 38 at a predetermined location, and provided with an undercut groove 86 to receive therein the flexible retention flange 84 when the attaching free end 83 is received therein. This flexible molding is utilized to provide a inwardly curved corner for refrigerated housings to facilitate cleaning and to prevent foodstuff from lodging in abrupt corners. As shown in the prior art FIG. 1B, it is necessary to mold the panels with such rounded corners, and this is also a costly process and a disadvantage of the prior art.

Figure 10:
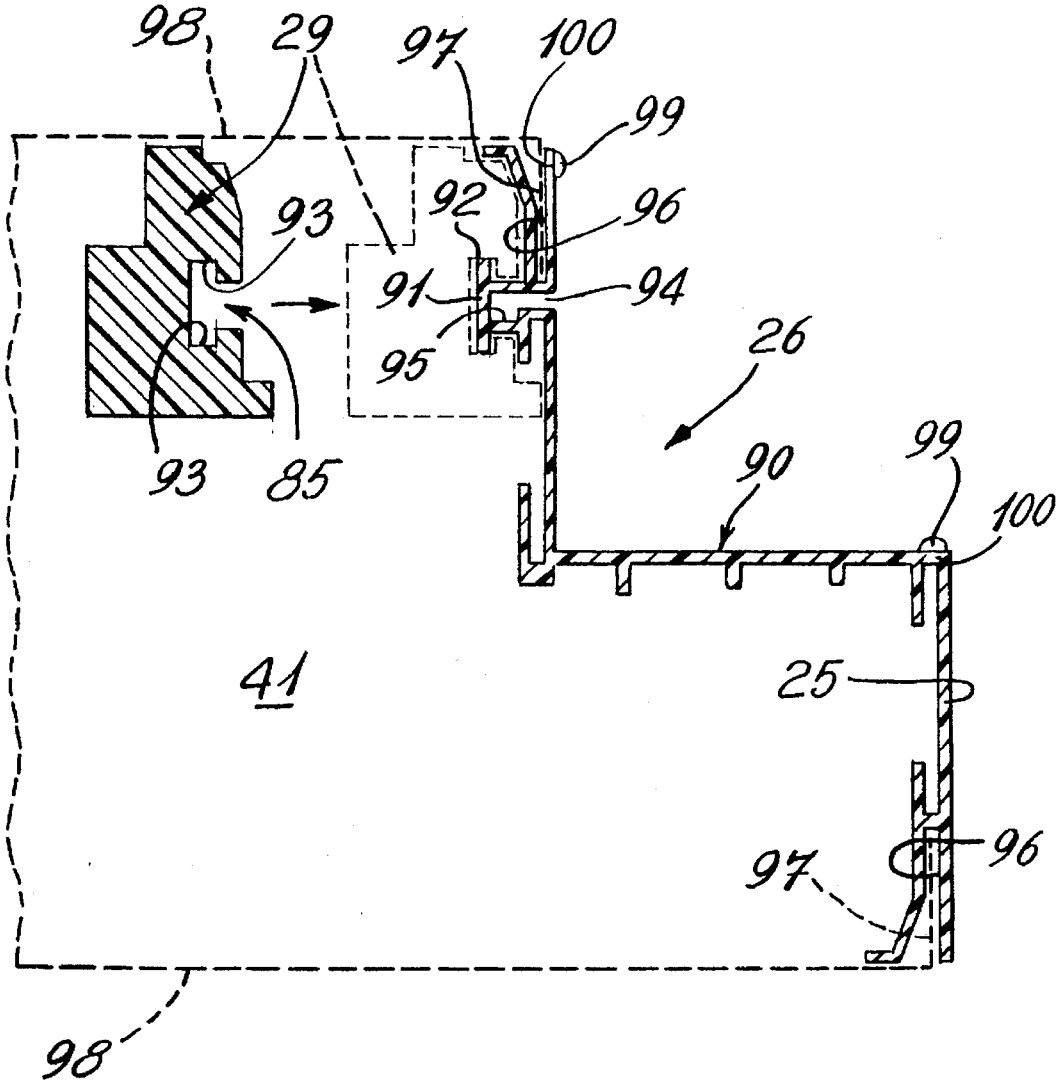
FIG. 10 is an end section view of a panel having cover strip molding secured over the entire end edge thereof and illustrating the positioning of the corner strip.

Referring now to FIG. 10, there is shown a cover strip molding 90 which is retained over the outer surfaces of the end edges of the panel including the right-angle connecting recess 26. This cover strip molding 90 is a flexible molding formed of PVC material, or other suitable material, and is provided with an attaching rib 91 which is configured for sliding fit retention in the molding clip receiving channel 85 of the connector member 29. The attaching rib 91 protrudes inwardly from a rear surface of the cover strip 90 and is provided with projecting retention wings 92 which are retained in opposed molding clip receiving channels 93 formed in the clip receiving channel 85 of the connector member 29. The rib also has a hollow clip engaging channel 94 on an outer face thereof provided with an undercut recess 95 for receiving the attaching free end 83 and flexible retention flange 84 of the flexible molding 80 therein.

As herein shown, the cover strip molding 90 extends along the right-angle connecting recess 26 and also extends over the end edge 25 of the panel to provide a smooth rigid end edge finish. Transverse retention slots 96 are formed along the outer end edges of the cover strip molding 90 for receiving therein a right-angle flange end 97 of covering sheets 98 secured over the insulating foam core 41 of the panel. Accordingly, it can be seen that the connector member 29 and the rigid cover sheets 98 can be assembled with the cover strip molding to form a hollow casing retained to receive the foam core 41 by injection. The foam further secures these elements interconnected together.

The cover strip 90 is also provided with an elongated beaded strip 99 of flexible sealing material and disposed along opposed outer edges 100 of the right-angle connecting recess 26. These sealing strips are provided for engagement with similar sealing strips provided on other interconnected panels or joint connectors. Sealing strips 101 may also be provided adjacent the end edge of the rear surface 81' of the right-angle portion 81 of the flexible molding 80, as shown in FIG. 9, to sealingly engage with adjacent panels in corners of an enclosure formed therewith.

It can therefore be seen from the improved modular panel construction of the present invention that the panels are more economical to construct, and enclosures can be erected more quickly. It is within the ambit of the present invention to cover any obvious modifications of the examples of the preferred embodiment described herein, provided such modifications fall within the scope of the appended claims

I claim:

1. A modular panel assembly of interconnectable rectangular modular panels, each said modular panels having opposed parallel outer and inner surfaces, side edges and end edges; said end edges each having a longitudinal right-angle connecting recess therealong and extending from across said side edges and having an opening in said inner surface, said longitudinal right-angle connecting recess defining a transverse end wall and a lateral planar flat wall, an elongated connector member secured along said connecting recess and disposed in contact with said transverse end wall, said connector member having a fastener receiving inner corner recess therealong, said lateral planar flat wall defining an abutment end wall having a dimension which is the same as the width of the outer surface of said elongated connector member, said connector member being constructed from material capable of receiving fasteners therein, said connecting member having at least a portion thereof disposed alongside an end portion of said inner surface of said panel whereby when two of said panels have their panel connecting recesses mated with one another one or more fasteners may be introduced through one of said connector members from a side of said inner surface of one of said panels to secure said connector members together to secure said two of said panels, and further connecting means along said side edges of said panel.

2. A modular panel as in claim 1 wherein said abutment end wall portion of said connecting recess is adapted to abut an outer surface of another connector member when said two panels have their panel connecting recesses mated.

3. A modular panel as in claim 1 wherein a further connector member is secured along an opposed one of said side edges, said further connector member being a floor connector member.

4. A modular panel as in claim 1 wherein said panel is an insulated modular panel.

5. A modular panel as in claim 4 wherein said modular panel has a solid core formed of rigid insulating material, a core cover sheet of suitable material secured over said opposed outer and inner surfaces, each said sheet having a contour flange secured to outer edge portions of said side edges and extending over said end edges about said connecting recesses, said connector member being concealed in said opposed surfaces by said cover sheet.

6. A modular panel as in claim 4 wherein said further connecting means along said side edge of said panel is a latch connector secured along said side edge thereof for interconnecting said panel with another adjacent panel along abutting side edges thereof.

7. A modular panel as in claim 1 wherein a tapered surface end portion is provided along said connector member opposite said inner corner recess.

* * * * *